United States Patent [19]

Antonious

[11] Patent Number: 4,907,806

[45] Date of Patent: Mar. 13, 1990

[54] PERIMETER WEIGHTED IRON TYPE GOLF CLUB HEAD WITH UPPER ALIGNMENT AND SIGHTING AREA AND CENTRALLY LOCATED COMPLEMENTARY WEIGHT

[76] Inventor: Anthony J. Antonious, 205 E. Joppa Rd., Towson, Md. 21204

[21] Appl. No.: 261,892

[22] Filed: Oct. 25, 1988

[51] Int. Cl.[4] ..... A63B 53/04

[52] U.S. Cl. ..... 273/164; 273/169; 273/167 F; D21/220

[58] Field of Search ..... 273/167–175, 273/77 R, 77 A, 162 R, 163 R, 164; D21/214–220

[56] References Cited

U.S. PATENT DOCUMENTS

| | | | |
|---|---|---|---|
| D. 95,819 | 6/1935 | Gourlay | D21/220 |
| D. 165,458 | 12/1951 | Jacobs | D21/220 |
| D. 256,264 | 8/1980 | Solheim | D21/220 |
| 1,320,163 | 10/1919 | Maurice | 273/171 |
| 2,087,685 | 7/1937 | Hackney | 273/167 F |
| 3,814,437 | 6/1974 | Winquist | 273/167 R |
| 4,326,326 | 4/1982 | MacDonald | 273/167 F |
| 4,345,763 | 8/1982 | Mitsui | D21/220 |
| 4,715,601 | 12/1987 | Lamanna | 273/80.2 |

OTHER PUBLICATIONS

Dennis, Larry, *Golf Digest,* 1979; p. 117, Photo of Butch Baird's Irons.

MacGregor, *Golf Digest,* 1988–Add for RPM Clubs.

Walter Hagen, *Golf Digest,* 1977, p. 72–Add for Ultradyne III Fore-Weighted Club.

*Primary Examiner*—Edward M. Coven
*Assistant Examiner*—Sebastiano Passaniti
*Attorney, Agent, or Firm*—N. J. Aquilino

[57] ABSTRACT

A perimeter weighted iron type golf club head having an upper alignment and sighting area formed on a top ridge of the club head approximate the toe and positioned perpendicular to the intended line of flight and parallel to the longitudinal axis of the club face to aid the golfer in aligning the club head "square" or perpendicular to the intended line in the address position. The club head also includes a centrally located complementary weight within the cavity in the back of the club head in the form of a concentrated mass located at the center of percussion of the golf club head.

6 Claims, 1 Drawing Sheet

PERIMETER WEIGHTED IRON TYPE GOLF CLUB HEAD WITH UPPER ALIGNMENT AND SIGHTING AREA AND CENTRALLY LOCATED COMPLEMENTARY WEIGHT

BACKGROUND OF THE INVENTION

The present invention relates to iron type golf club heads and, in particular, to an improved peripheral weighted iron type golf club head having an alignment and sighting means on its upper surface to aid a golfer in positioning the golf club head in a perpendicular direction, or as known in golf to be "square" to the intended target and a centrally located complementary weight at the center of percussion.

With conventional iron type golf club heads, individual clubs in the set are formed with a top-ridge located on the top of the club which diverges in an angular direction upwardly and outwardly from the hosel toward the toe of the club head. This conventional structure has been developed for iron type golf club heads to maximize the weighting characteristics of the club head and to maximize the ball striking surface on the club head. This distribution of the weight toward the toe balances the club head while maintaining the center of percussion generally near the center of the ball striking face. A shortcoming of this design is that the top edge or top ridge line of the club head because of the diverging direction makes it impossible to use for alignment purposes. Various attempts have been made to provide a club head with a basically rectangular shaped club face and a top line extending straight across the entire length of the ball striking face in a direction perpendicular to the intended target line for alignment purposes as shown in the U.S. Patent to Swanson (4,345,763). Peripheral weighted golf clubs are also quite well known as evidenced in the patent to Solheim (D-276,644).

SUMMARY OF THE INVENTION

The present invention provides an improved golf club head having the advantages of peripheral weighted golf club heads while including alignment features to enable a golfer to properly align a club prior to executing a golf shot and a weighting configuration which enhances the shot making ability of the club head when the ball is struck at the center of percussion.

The present invention provides a perimeter weighted golf club head wherein a peripheral mass is provided forming a cavity recess in the back of the club head for weight distribution. The club head further includes a sighting or alignment means formed on the uppermost portion of the top ridge of the club head toward the toe which enables a player at address to position a club head square to the intended line of flight. The sighting section is formed parallel to the longitudinal axis between the toe and heel of the club face and adjacent to and substantially at the toe portion of a club head and it is substantially parallel to the sole of the club head so that when a club is at address the sighting section would be perpendicular to the intended line of flight. The approximate weight removed from the toe portion to form the parallel sighting section is redistributed and located at the center of percussion in the form of a rounded concentrated mass or weight. This considerable mass may be in the form of a cylinder, a semihemisphere, an oval or other shape located within the rear cavity in back of or outwardly from the center of percussion of the club head.

This improved golf club head provides an alignment means to enable a user to position the club head properly when addressing a ball and also provides considerable weighting means at the center of percussion to produce a more solid feel when a ball is struck at the center of percussion, thereby producing greater accuracy and improved feel which permits the golf balls to travel further, straighter and with a more desirable trajectory.

Among the objects of the present invention are to provide a peripheral weighted iron type golf club head which provides a golfer with a sighting and alignment means and a weighting arrangement providing improved feel, better control, increased accuracy and more distance when a golf ball is struck. Another object is to provide an iron type golf club head wherein the result of a novel weight distribution provides an improved sighting area and also provides a substantially more solid mass concentrated behind the precise center of percussion area for peripheral weighted iron type golf clubs.

These and other objects will become apparent with reference to the accompanying drawings and the following specification which illustrates the embodiments of the invention.

DESCRIPTION OF THE PREFERRED EMBODIMENTS

Figure 1:
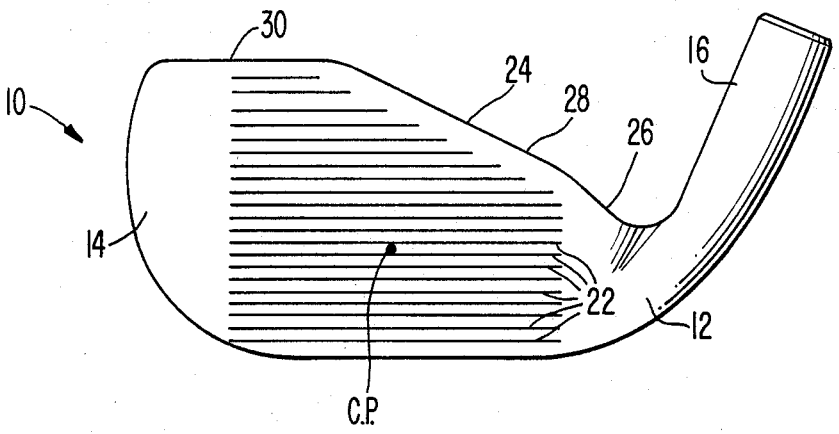
FIG. 1 illustrates a front perspective view of a golf club head in accordance with the present invention.

Referring to the drawings, the preferred embodiments of the present invention are illustrated. Whenever possible, the same or like reference numerals will be used throughout the drawings to refer to the same or like parts.

Figure 2:
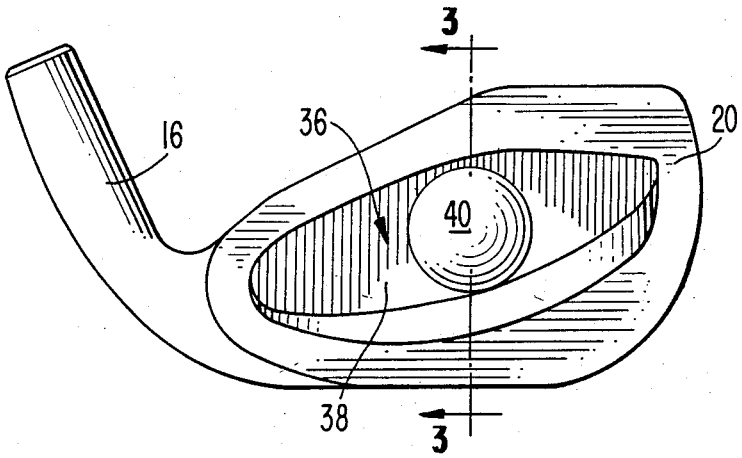
FIG. 2 is a rear perspective view of the golf club head of FIG. 1.
Figure 3:
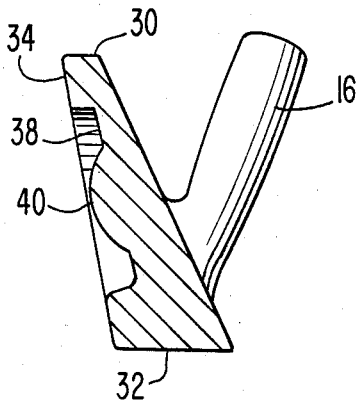
FIG. 3 is a side sectional view taken along the line 3—3 FIG. 2.

FIGS. 1 to 3 illustrate one embodiment of the golf club head 10 of the present invention. The club head 10 is a conventional peripheral weighted iron type golf club head including a heel 12, toe 14, hosel 16, ball striking face 18 and complementary rear face 20. The club head 10 has a center of percussion CP shown on the ball striking face 18. It is known in the art, that the center of percussion is located at approximately the center of the club head, the exact position being precisely controlled by the weight distribution on the club head itself and it represents the spot where a ball would ideally be struck to provide maximize transfer of energy during the swing for maximum distance and control.

The ball striking face of an iron type club having a loft angle greater than 12 degrees, includes a plurality of grooves 22 of conventional design which, when viewed by a golfer, are perpendicular to the normal intended line of flight.

The club head includes a top ridge 24 which extends upwardly and outwardly from the heel 12 toward the toe 14 of the club head 10. In the embodiment shown, the top ridge includes a first section 26 adjacent the heel 12 which extends at a steeper angle away from the heel, a second intermediate section 28 also extending at a divergent angle from the heel toward the toe, and a third straight sighting section 30 which extends substantially horizontally between the heel and toe so as to be parallel to the grooves 22 and perpendicular to the intended line of flight. The sighting section 30 forms a flat area located above the ball striking face 18 between the toe 14 and the interface of the intermediate top ridge section 28. The sighting section 30 extends partway across the width and above the ball striking face 18 at a substantial distance from the hosel 16. In a preferred embodiment, as shown, the length of the sighting section is approximately one-third (⅓) the longitudinal distance of the club head. It will be appreciated that the sighting section may extend further between the toe and the heel in keeping within the spirit and scope of the invention. Preferably, the upper surface would be flat and generally parallel to the bottom or sole 32 of the club head 10. This further insures that the sighting section is parallel to the ground surface when it is placed in the shot making position which is then perpendicular to the intended line of flight.

Referring to FIG. 2, the club head includes a rear peripheral weight 34 which extends around the perimeter of the rear face 20, the peripheral weight distribution forms a cavity 36, the bottom of which constitutes a rear wall 38 which is spaced from the rear face 20.

The portion of the golf club head removed from the conventional club toe portion to form the sighting section 30 is relocated and positioned directly behind the center of percussion in the form of concentrated mass 40 which is generally centrally located within the cavity 36. In this embodiment, the weight is rounded in the form of a semi-hemispherical mass of weight, the center of which is located directly at the center of percussion.

By removing the weight from the upper toe portion and placing it directly behind the center of percussion, the overall weight of the club head remains practically unchanged. However, the location of the concentrated mass 40 directly behind the center of percussion in combination with the peripheral weight 34 on the rear face 20 provides a golf club which produces a more solid feel when the ball is struck at the precise center of percussion and because of the proximity to this concentrated mass a more solid feel even when the ball is misshit off of the center of percussion since the peripheral mass 24 transfers additional energy to the ball to produce a more solid feel than other perimeter weighted or non-perimeter weighted club heads. Therefore, the present invention provides the optimum in terms of feel and accuracy when a golf ball is struck, not only at the center of percussion, but also for off-center hits toward the periphery of the club head. In addition, the club head provides an alignment and sighting section which enables a golfer to properly align a club head to the ball prior to the execution of the shot, thereby maximizing the chances of hitting the ball on the proper trajectory path.

Figure 4:
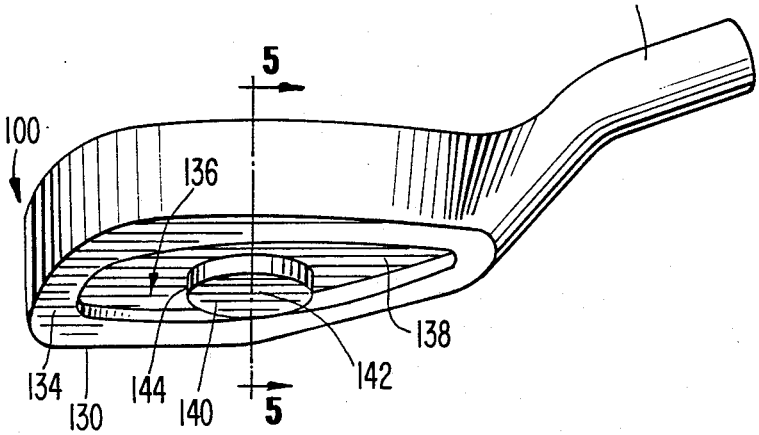
FIG. 4 is a bottom view of a second embodiment of a golf club head in accordance with the present invention.
Figure 5:
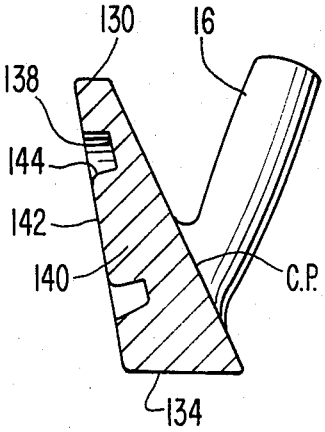
FIG. 5 is a side sectional view taken along the line 5—5 of FIG. 4.

FIG. 4 illustrates a rear view of a second embodiment of a golf club head 100 of the present invention. In this embodiment, the club head is essentially the same as the embodiment described with respect to FIGS. 1 to 3 including a peripheral mass 134 and a sighting section 130. In this embodiment, a concentrated mass 140 is located on the rear wall 138 of the cavity 136. This concentrated mass 140 is positioned outwardly from and opposite the center of percussion and is cylindrical in shape having a relatively flat top surface 142 and a straight annular side wall 144 as illustrated.

The shape of the concentrated mass may assume various shapes in addition to the rounded structures described hereinabove. For example, the mass may be oval, square, rectangular or any other shape.

It will further be appreciated that the improved golf club head has been described with respect to the specific embodiments as shown and still other changes and modifications may be made without departing from the spirit and scope of the invention as defined in the appended claims.

I claim:

1. An iron type golf club head having an improved weight distribution and sighting and alignment means comprising:

a main body including a heel, hosel proximate said heel, a toe, a sole, a back, a ball striking face to hit the ball along an intended line of flight, a center of percussion on said ball striking face, a complementary rear face, and a top ridge extending from the hosel to the toe;

sighting and alignment means formed on only a portion of said top ridge of said golf club head, said sighting and alignment means including a straight section on said top ridge extending in a direction from heel to toe perpendicular to the intended line of flight from a first point adjacent said toe to a second point located between said toe and said hosel and spaced substantially from said hosel;

a peripheral mass formed on at least the heel, toe and lower surface portions of the outer periphery of said rear face of the club head;

said peripheral mass defining a cavity located on said rear face of the club head and providing a perimeter weighting for the club head; said cavity having side walls extending outwardly from said complementary rear face; and a centrally located, rounded, concentrated weight member formed completely within said cavity and spaced from said cavity side walls and located on said complementary rear face at said center of percussion; said weight member being further characterized by a raised surface extending rearwardly from said rear face to substantially in alignment with the rearmost said peripheral mass and in the same direction as said side walls of said peripheral mass, the extremities of said weight member being spaced radially about said center of percussion.

2. The golf club of claim 1 wherein said weight member is further characterized by a mass approximately equal to the weight removed from the upper top ridge to form said sighting and alignment means.

3. The golf club head of claim 1 wherein said concentrated weight member is cylindrical in shape having a flat top surface and straight annular side walls, said weight member being centrally located with respect to said center of percussion.

4. The golf club head of claim 1 wherein said ball striking face has a loft angle of at least 12 degrees with respect to the vertical.

5. The golf club head of claim 1 wherein said concentrated weight member is rounded in shape.

6. The golf club head of claim 5 wherein said centrally located concentrated weight member is semi-hemispherical in shape and is centrally located with respect to said center of percussion.

* * * * *